US010163542B2

(12) United States Patent
Han et al.

(10) Patent No.: US 10,163,542 B2
(45) Date of Patent: Dec. 25, 2018

(54) METHOD OF REMOVING IMPURITIES FROM NATURAL ESTER, OIL-BASED DIELECTRIC FLUIDS

(71) Applicant: Union Carbide Chemicals & Plastics Technology LLC, Midland, MI (US)

(72) Inventors: Suh Joon Han, Belle Mead, NJ (US); Peter C. Dreux, Lumberton, NJ (US); Paul J. Caronia, Annadale, NJ (US); Daniel Witte, Inez, TX (US)

(73) Assignee: Union Carbide Chemicals & Plastics Technology LLC, Midland, MI (US)

( * ) Notice: Subject to any disclaimer, the term of this patent is extended or adjusted under 35 U.S.C. 154(b) by 0 days.

(21) Appl. No.: 15/799,072

(22) Filed: Oct. 31, 2017

(65) Prior Publication Data

US 2018/0053579 A1 Feb. 22, 2018

Related U.S. Application Data

(63) Continuation of application No. 13/990,922, filed as application No. PCT/US2011/059953 on Nov. 8, 2011.

(60) Provisional application No. 61/428,298, filed on Dec. 30, 2010.

(51) Int. Cl.
*H01B 3/20* (2006.01)

(52) U.S. Cl.
CPC ..... *H01B 3/20* (2013.01)

(58) Field of Classification Search
CPC ..... H01B 3/20
See application file for complete search history.

(56) References Cited

U.S. PATENT DOCUMENTS

| | | | | |
|---|---|---|---|---|
| 2,498,353 | A | 2/1950 | Bierce | |
| 5,354,570 | A | 10/1994 | Friedman | |
| 5,958,851 | A * | 9/1999 | Cannon | C10M 101/04 174/17 LF |
| 6,280,659 | B1 | 8/2001 | Sundin | |
| 6,808,621 | B1 * | 10/2004 | Cisneros | C01B 6/04 208/133 |
| 2013/0264527 | A1 * | 10/2013 | Han | H01B 3/20 252/579 |
| 2015/0005420 | A1 * | 1/2015 | Mundra | C08K 5/0016 524/114 |

FOREIGN PATENT DOCUMENTS

| | | | |
|---|---|---|---|
| EP | 00295418 | A2 | 12/1988 |
| EP | 0307716 | A1 | 3/1989 |
| FR | 1400279 | A | 5/1965 |
| JP | 2007042420 | A * | 2/2007 |

(Continued)

OTHER PUBLICATIONS

WO2006128734, Enzler, An English Translation.*
Machine translation of FR1400279.

*Primary Examiner* — Nicole M. Buie-Hatcher
*Assistant Examiner* — M. Reza Asdjodi
(74) *Attorney, Agent, or Firm* — Husch Blackwell LLP

(57) ABSTRACT

The method of manufacturing a natural ester, oil-based electrical insulation fluid by contacting refined, bleached, optionally winterized, and deodorized natural ester oil, e.g., soy oil, with an absorbent is improved by using as the absorbent a synthetic silicate absorbent comprising an alkali and/or alkaline earth metal, e.g., magnesium.

11 Claims, 4 Drawing Sheets

(56) References Cited

FOREIGN PATENT DOCUMENTS

| | | | | | |
|---|---|---|---|---|---|
| WO | WO 9749100 | A1 * | 12/1997 | ..... | H01B 3/20 |
| WO | WO 9831021 | A1 * | 7/1998 | ..... | C10M 169/04 |
| WO | 2005037969 | A2 | 4/2005 | | |
| WO | WO 2006128734 | A1 * | 12/2006 | ..... | C11B 3/10 |

* cited by examiner

METHOD OF REMOVING IMPURITIES FROM NATURAL ESTER, OIL-BASED DIELECTRIC FLUIDS

BACKGROUND OF THE INVENTION

1. Field of the Invention

This invention relates to dielectric fluids. In one aspect the invention relates to natural ester, oil-based dielectric fluids while in another aspect, the invention relates to a method of removing impurities from such fluids. In still another aspect the invention relates to removing such impurities using an absorbent while in yet another aspect, the invention relates to the use of such dielectric fluids.

2. Description of the Related Art

Power losses that occur during transformer operation are the result of one or more factors. Whatever the factor or factors, however, all transformer power losses manifest themselves as heat. To prevent excessive temperature rise and premature transformer failure, transformers are filled with a liquid coolant to dissipate the generated heat. Natural ester oils have been used as an advanced dielectric insulating medium because not only do they have excellent dielectric characteristics with high temperature stability and superior flash and fire resistance (e.g. fire point greater than 300 C), but because they are also friendly to the environment.

The manufacture of natural ester, oil-based transformer oil, however, typically requires multiple steps to process the oil to the standard specifications required for the oil to perform as a dielectric fluid in a transformer. Among these steps is the removal of impurities in the oil that can interfere with its performance and/or adversely affect the length of its service life.

U.S. Pat. No. 6,280,659 teaches a method for manufacturing a vegetable seed oil-based electrical insulating fluid, the method comprising the steps of (1) providing a vegetable seed oil or blend of vegetable seed oils, (2) heating the vegetable seed oils to a temperature of between 80° C. and 100° C., and (c) purifying the heated vegetable seed oil or blend of vegetable seed oils to remove substantially all polar contaminants, free fatty acids, and particulate materials. The step of purifying the oil comprises mixing the oil with a blend of activated clay, e.g., Fuller's earth, and activated alumina which is subsequently separated from the oil by passing the oil through a filter and degasifying the purified vegetable oils to remove moisture and other gases. The degasifying step reduces the moisture content of the oil to less than or equal to 200 parts per million (ppm). Typically the oil is stabilized against oxidation by the addition of one or more oxidation inhibitors.

SUMMARY OF THE INVENTION

In one embodiment the invention is an improved method for manufacturing natural ester, oil-based electrical insulation fluids, i.e., a dielectric fluid, utilizing a synthetic silicate absorbent comprising an alkali metal and/or alkaline earth metal. These absorbents surprisingly outperform other absorbent media, e.g., natural clays and/or alumina, in terms of power factor control and neutralization number control at temperatures ranging from 25° C. to 70° C.

In one embodiment the invention is a method for manufacturing natural ester, oil-based electrical insulation fluids, the method comprising the steps of: (A) contacting refined, bleached and deodorized (RBD) natural ester oil, or refined, bleached, winterized and deodorized (RBWD) natural ester oil, with a synthetic silicate absorbent comprising an alkali metal and/or alkaline earth metal, and (B) separating the absorbent from the oil.

In one embodiment the invention is method of manufacturing natural ester, oil-based electrical insulation fluids, the method comprising the steps of: (A) degumming a crude natural ester oil, (B) subjecting the degummed crude oil to at least one of alkaline and acidic bleaching, (C) optionally winterizing (i.e., cold fractionating) the degummed and bleached crude oil to remove or reduce the amount of any remaining waxy compounds, (D) deodorizing the degummed, bleached and optionally winterized natural ester oil to remove or reduce the amount of any remaining volatile impurities to produce a refined, bleached and deodorized (RBD) or refined, bleached, winterized and deodorized (RBWD) natural ester oil, (E) contacting the RBD or RBWD natural ester oil with a synthetic silicate absorbent comprising an alkali metal and/or alkaline earth metal, and (F) separating the absorbent from the oil.

In one embodiment the invention is an improved method for manufacturing natural ester oil-based electrical insulation fluids, the method comprising the step of contacting a RBD or RBWD natural ester oil with an absorbent, the improvement comprising using as the absorbent a synthetic silicate comprising an alkali metal and/or alkaline earth metal.

In one embodiment the invention is a dielectric fluid made by the inventive method described above. These fluids meet the functional standards as described in ASTM D6871.

In one embodiment the invention is a transformer containing a dielectric fluid made by the inventive method.

DETAILED DESCRIPTION OF THE PREFERRED EMBODIMENT

Definitions

Figure 1:
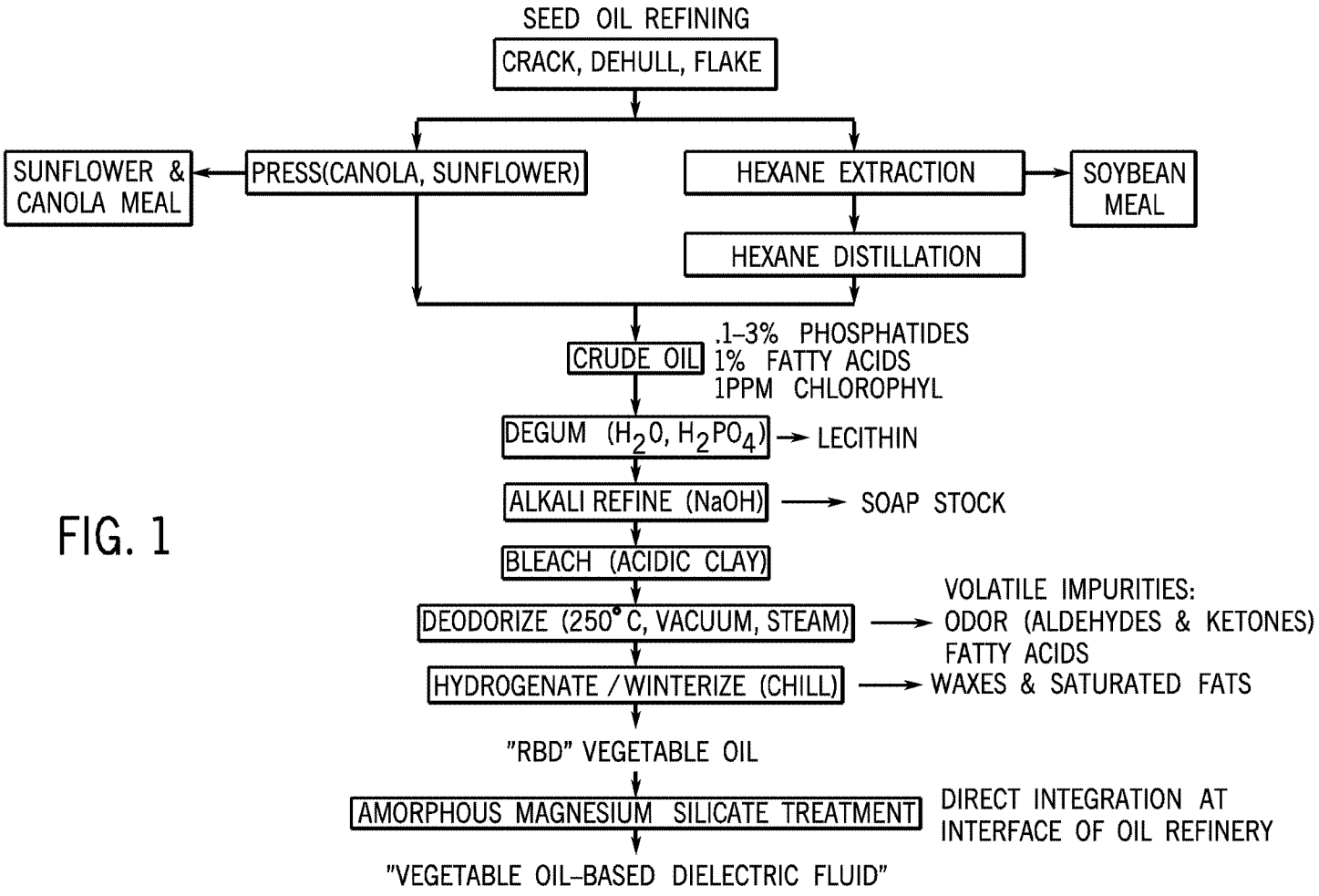
FIG. 1 is a flow diagram of the steps in a typical seed oil refining process.
Figure 2:
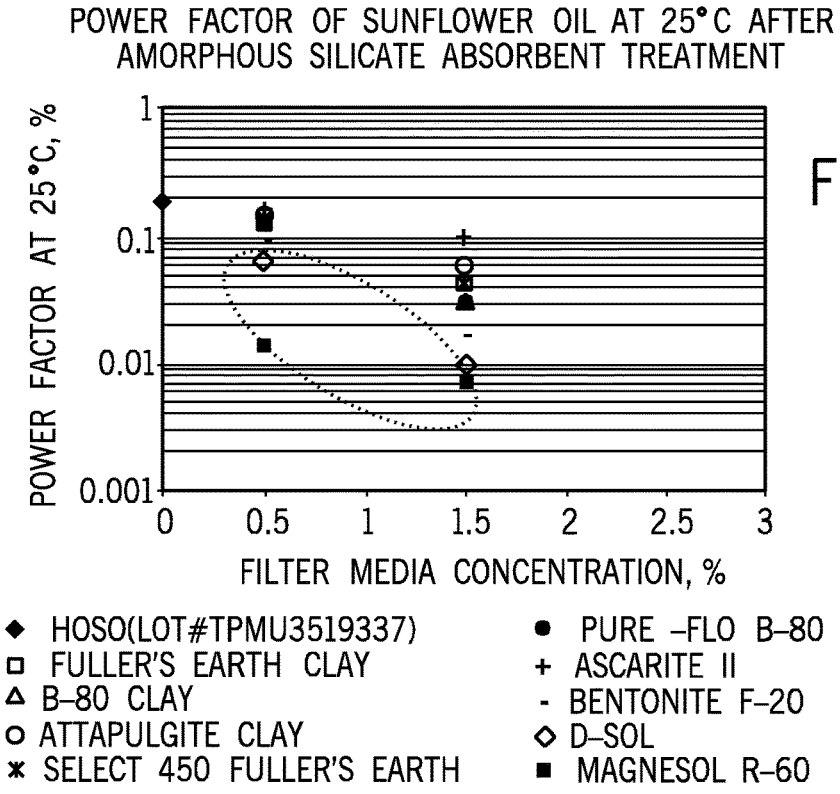
FIG. 2 is a diagram reporting the power factor of sunflower oil at 25° C. after treatment with a synthetic silicate absorbent comprising an alkali metal and/or alkaline earth metal.
Figure 3:
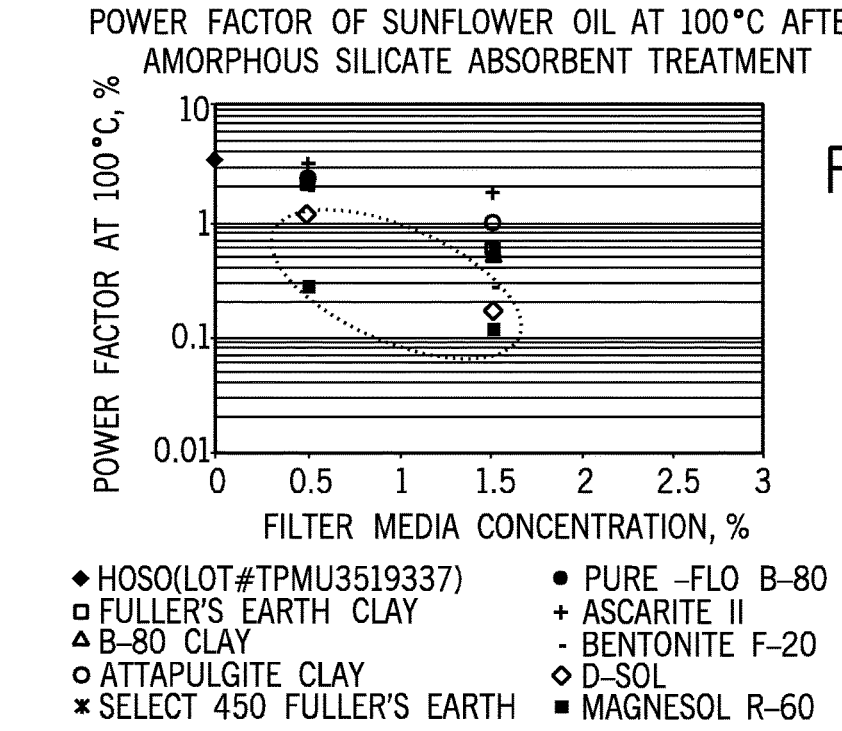
FIG. 3 is a diagram reporting the power factor of sunflower oil at 100° C. after treatment with a synthetic silicate absorbent comprising an alkali metal and/or alkaline earth metal.
Figure 4:
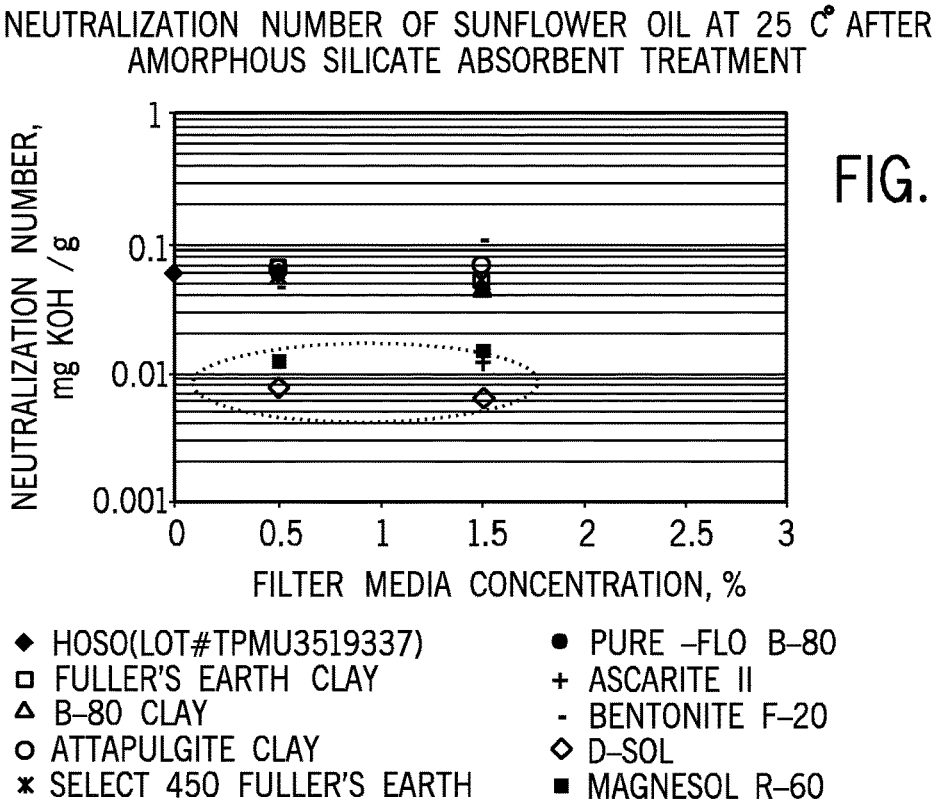
FIG. 4 is a diagram reporting the neutralization number of sunflower oil at 25° C. after treatment with a synthetic silicate absorbent comprising an alkali metal and/or alkaline earth metal.
Figure 5:
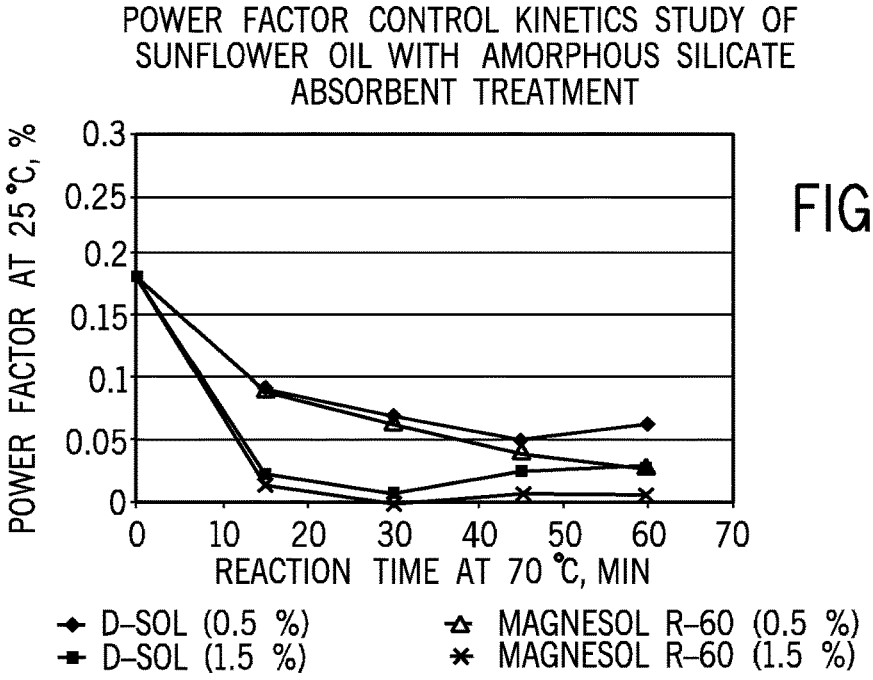
FIG. 5 is a graph reporting the power factor control kinetics of sunflower oil after treatment with a synthetic silicate absorbent comprising an alkali metal and/or alkaline earth metal.
Figure 6:
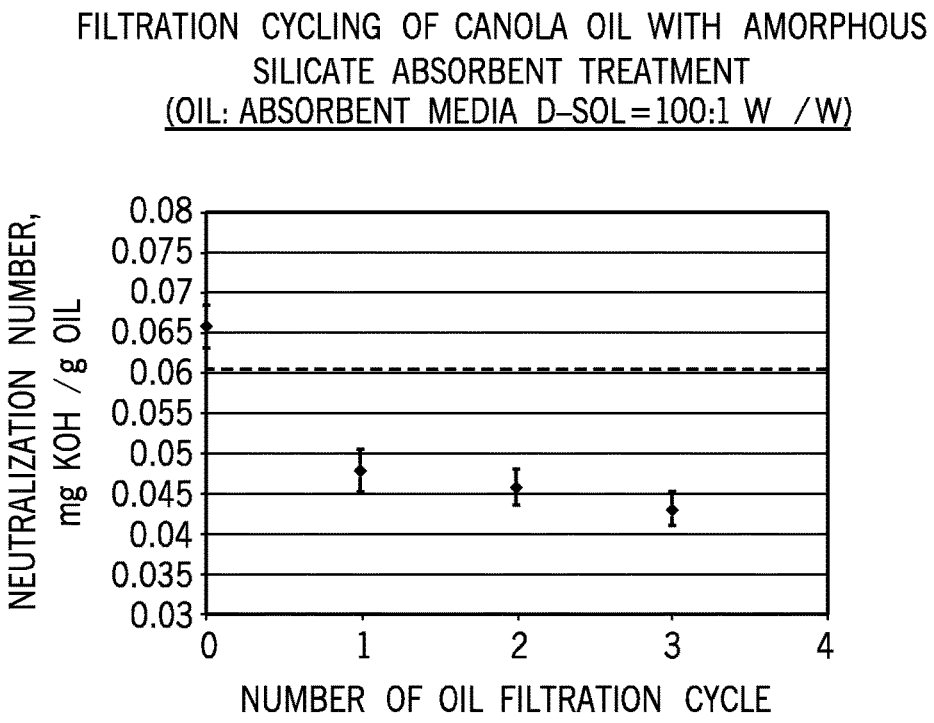
FIG. 6 is a graph reporting the filtration cycle of canola oil with a synthetic silicate absorbent comprising an alkali metal and/or alkaline earth metal.

Unless stated to the contrary, implicit from the context, or customary in the art, all parts and percents are based on weight and all test methods are current as of the filing date of this disclosure. For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, etc., is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure.

"Power factor" and like terms mean a measure of the dielectric losses in an electrical insulating liquid when used in an alternating electrical field and of the energy dissipated as heat. It is measured by ASTM D924. A low power factor indicates low AC dielectric losses of the oil.

"Neutralization number" and like terms mean a measure of the amount of acidic or basic substances in the oil. New and used oil products may contain basic or acidic constituents that are present as byproducts or additives or degradation products formed during refining of the oil. It is measured by ASTM D974. A low neutralization number indicates low acidic constituents in the oil.

"Degumming", "water refining" and like terms mean, in the context of this invention, treatment of the natural ester oil with a small amount of water, followed by centrifugal separation to remove phospholipids and similar waxy or gummy solids.

Natural Ester Oils

The natural ester oils used in the practice of this invention are oils derived from vegetable and/or seeds and/or other natural sources (as opposed to mineral, e.g., petroleum, sources) and include, but are not limited to, castor, soybean, olive, peanut, rapeseed, corn, sesame, cotton, canola, safflower, linseed, palm, grapeseed, black caraway, pumpkin kernel, borage seed, wood germ, apricot kernel, pistachio, almond, macadamia nut, avocado, sea buckthorn, hemp, hazelnut, evening primrose, wild rose, thistle, walnut, sunflower, jojoba seed oils, algal oils, bio oils from bacterial or fungal or animal sources, or a combination of two or more of these oils. Preferred natural ester oils are those with sufficient saturation to function as insulating oils, i.e., those oils that exhibit good chemical, oxidative and hydrolytic stability such as sunflower seed oil, canola or rapeseed oil, castor oil, meadowform seed oil, and jojoba oil. Those oils that initially are highly unsaturated and are therefore normally undesirable for use as insulating oils may also be used as insulating oils if their stability and resistance to oxidation are enhanced by genetic, chemical or other means, e.g., are subjected to hydrogenation. These other vegetable seed oils include, for example, corn oil, olive oil, peanut oil, sesame oil, coconut oil, and soybean oil.

The natural ester oils used in the practice of this invention can be used neat or in combination with one or more other oils such as, but not limited to, those refined from natural petroleum oils, synthetic hydrocarbons, polyolefins, organic or inorganic esters and alkyl silicone compounds. These other fluids may be added to improve the stability and/or oxidation resistance, to lower the cost of the dielectric fluid, or to improve the functional characteristics of the vegetable seed oil. If the vegetable seed oils used in the practice of this invention are blended with one or more other fluids (e.g., mineral oil, synthetic ester oil, polyolefin oil, etc.), typically the natural ester oil comprises at least 50, or at least 60, or at least 70, or at least 80, or at least 90, weight percent (wt %) of the blend.

Natural Ester Oil Refining

The process of extracting natural ester oil from vegetable seeds is well known and illustrated in FIG. 1. After drying and separation from the parent plant and any extraneous debris, seeds are cracked, dehulled and flaked. The processed seeds are then subjected to an oil extraction process, e.g., pressing for sunflower and canola seeds, hexane extraction for soybean seeds, etc., to produce a crude oil and a meal. The crude oil typically comprises a blend of paraffinic or iso-paraffinic molecules of 16 to 20 carbons that contain one or more double bonds (i.e., unsaturated bonds). These bonds are weak points in the molecular structure and are the first sites of oxidative degradation. Molecules of 16-20 carbon atoms give the oil a molecular weight and structure that provides a good balance of flammability characteristics (vapor pressure) and viscosity. Oils with chains having a carbon atom count much outside of this range are either too volatile or too viscous for use as an insulating fluid. As such, oils comprising mostly of molecules with the lowest number of double bonds, preferably a single double bond, and with 16-20 carbon atoms are preferred. Comparable extraction processes are known for non-vegetable seed oils, e.g., algal, fungal, bacterial and animal sourced oils.

The crude oil contains impurities that can adversely affect the performance of the oil as a dielectric fluid. These impurities include such compounds as, but not limited to, water, free fatty acids, aldehydes, ketones, phosphatides, metal soaps, lecithin, trace metals and the like. Preferably these impurities are removed, or at least reduced in amount, before the vegetable seed oil is deployed as a dielectric fluid. These contaminants can be removed through a series of extraction/absorption steps. For example, and as illustrated in FIG. 1, the crude oil can be subjected to a degumming step in which water and lecithin and other phosphatides are removed as well as other unwanted compounds that may be present, e.g., chlorophylls, trace metals, aldehydes, ketone and the like; followed by alkaline and/or acidic (bleaching) to remove color bodies and such other unwanted compounds that may be present like phospholipids and hydrolysis byproducts, e.g., soaps; followed by vacuum and/or steam treatment to remove odiferous compounds; followed by hydrogenation and/or cooling to remove saturated fats and waxes. Although the order of steps in FIG. 1 is typical, the steps can be re-ordered as desired. The resulting refined, bleached, optionally winterized, and deodorized ("RBD" or "RBWD") oil, while much improved over the starting crude oil in the context of suitability for use as a dielectric fluid, often still contains unwanted contaminants.

RBD or RBWD Oil Finishing

In one embodiment of this invention, removal of, or at least a significant reduction (e.g., greater than 50, or 60, or 70, or 80, or 90, or 95 percent) in the amount of, these remaining contaminants is accomplished by contacting the RBD or RBWD oil with a synthetic silicate absorbent comprising an alkali metal and/or alkaline earth metal. The contacting typically involves mixing an amount of absorbent with the RBD or RBWD oil, agitating the mixture to ensure a thorough blending of the two components, and subsequently removing the absorbent by any convenient means, e.g., filtration.

The silicate absorbents used in the practice of this invention are synthetic in the sense that they are manufactured as opposed to naturally occurring. The method by which the synthetic silicate absorbent is manufactured can vary, and one such method is the acid, e.g., hydrochloric acid, treatment of an alkali metal silicate, e.g., sodium silicate. Representative naturally occurring absorbents include Fuller's earth, Attapulgite clay and bentonite clay. Naturally occurring absorbents are not manufactured absorbents simply because they are subjected to a treatment of one kind or another, e.g., crushing, washing, drying, etc., before use as an absorbent.

The synthetic silicate absorbent comprising an alkali and/or alkaline earth metal used in the practice of this invention is typically amorphous and has a porous internal structure with large active sites (sometimes referred to as cages or cavities). These active sites contain an alkali metal or alkaline earth metal, i.e., a member of Group 1 or 2 of the Periodic Table of the Elements (Handbook of Chemistry and Physics, 71$^{st}$ Ed., (1990-1991)). Preferred metals include sodium, potassium, magnesium, calcium and barium. These metals can be introduced into silicate in any convenient method, e.g., ion exchange, and the amount of metal loaded or doped into silicate can vary to convenience. The estimated BET surface area of the absorbent is typically greater than 100, or 200, or 300 square meters per gram ($m^2/g$). The synthetic silicate absorbents comprising an alkali metal and/or alkaline earth metal are commercially available from a number of different sources, e.g., D-SOL and MAGNESOL R-60 synthetic magnesium silicates from The Dallas Group of America, Inc.

The absorbent process is the physical and chemical interaction of the absorbent with an oil to improve the quality of the oil. The effectiveness of the absorbent depends, in large part, on the surface attraction involving Vander der Waals forces, chemical bonding to the surface, chemi-sorption via molecular and ionic bonds, and molecular entrapment. Intimate mixing of the absorbent and oil is desired, and this can be achieved in any number of different manners, e.g., batch mixing in a vessel, or column filtration by absorbent media cartridges, or fluidized bed operations, or slurry processes, or suction or pressure filters, or membrane cartridges under vacuum in a temperature range from room temperature to 100° C. The more preferred temperature at which to conduct the absorption process is below 80° C. to avoid thermal oxidation of the natural ester oil. For reasons of economy, preferably the absorbent/oil ratio is low, e.g., in the range of 0.01/1 to 0.2/1, the exact ratio dependent on a number of factors including but not limited to contract time and contact surface area. In general, the shorter the contact time, the higher the absorbent/oil ratio. In one embodiment the absorbent/oil ratio is from 0.02/1 to 0.15/1. In one embodiment absorbent/oil ratio range is 0.05/1 to 0.2/1. In one embodiment the contact time is an hour or less. In those operations requiring mixing, e.g., a batch process, the mixing can be by mechanical agitator or pump. The absorbent cartridge operation required the circulation pump for oil flow control.

In a batch mixing process, the absorbent can be separated by centrifuge, mechanical press and with a series of bag filters ranging in mesh size from 1 to 100 microns.

The dielectric fluids made by the method of this invention are used in the same manner as known dielectric fluids. These fluids meet the functional requirements of ASTM D6871 which are the standard specifications for natural ester fluids used in electrical apparatus.

SPECIFIC EMBODIMENTS

Materials

The high oleic sunflower oil (HOSO) used in this study comprised about 85% oleic acid and had a high power factor.

D-SOL and MAGNESOL R-60 are synthetic silicate absorbents comprising magnesium. The particle size was about 50~70 microns and it is available from The Dallas Groups of America, Inc.

Fuller's earth clay is sedimentary clay that contains a high proportion of minerals of the semectic groups. B-80 clay is bleaching clay. It is available from Oil Dri Corporation of America. Attapulgite clay is a clay-like material of variable composition, mainly consisting of silicon, aluminum and iron oxides. It is available from Active Minerals International, LLC. SELECT 450 is Fuller's earth from Oil Dri Corporation of America. PURE-Flo B-80 is a mixture of montmorillonite clay from Oil Dri Corporation of America. ASCARITE II is a sodium hydroxide coated non-hydrous silicate from J. T. Baker. Bentonite (CAS #70131-50-9) is an absorbent aluminum phyllo-silicate. It is available from BASF.

Test Procedure

The effectiveness of various absorbents to remove contaminants from RBD sunflower oil is determined by batch mixing on a laboratory scale the oil with the various absorbents. Each test sample of absorbent and oil comprises either 0.5 or 1.5 wt % absorbent, and each sample is mixed for one hour at 70° C. while stirring with a magnetic stirring bar. After mixing, the absorbent is separated from the oil using FILTERWARE apparatus which comprises a glass body and a porous filtration section. Oil is recovered at 70° C. and intervals of 15, 30, 45 and 60 minutes, and is then subjected to kinetics studies by testing key material characteristics. The results are reported in the graphs of FIGS. 2-6.

As reported in FIGS. 2-6, the synthetic silicate absorbent comprising magnesium exhibited much better control for both the power factor and the neutralization number. This silicate absorbent required only 10-15 minutes to control the power factor at both 25° C. and 100° C. while the naturally occurring absorbents achieved only a fraction of that control in the same time period. Moreover, the synthetic silicate absorbent comprising magnesium lowered the acidity of the oil (less than 0.06 mg KOH/g-oil (which is the industry standard) after only 1 filtration cycle.

Although the invention has been described with certain detail through the preceding description of the preferred embodiments, this detail is for the primary purpose of illustration. Many variations and modifications can be made by one skilled in the art without departing from the spirit and scope of the invention as described in the following claims.

What is claimed is:

1. A method for manufacturing a natural ester oil-based electrical insulation fluids, the method comprising the steps of:

(A) providing a column filtration system having an absorbent media cartridge, the absorbent media cartridge containing particles of synthetic magnesium silicate absorbent having a BET surface area greater than 200 $m^2/g$ and a particle size from 50 μm to 70 μm;

(B) passing a flow of a refined, bleached and deodorized (RBD) natural ester oil, or a refined, bleached, winterized and deodorized (RBWD) natural ester oil through the absorbent media cartridge, the oil at a temperature of less than 80° C.;

(C) controlling, with a circulation pump, the oil flow through the absorbent media cartridge to contact the refined, bleached and deodorized (RBD) natural ester oil, or the refined, bleached, winterized and deodorized (RBWD) natural ester oil, with the particles of synthetic magnesium silicate absorbent at an absorbent/oil ratio from 0.01/1 to 0.2/1;

(D) separating the absorbent from the oil, wherein a combination of one (C) controlling step and one (D) separating step forms one filtration cycle; and (E) forming a natural ester oil-based electrical insulation fluid having, after one filtration cycle, (i) a neutralization number of less than 0.06 mg KOH/g-oil and (ii) a power factor at 25° C. of less than 0.1%.

2. The method of claim 1 comprising the steps of:

(1) degumming a crude natural ester oil, (2) subjecting the degummed crude oil to at least one of alkaline and acidic bleaching, (3) optionally winterizing the degummed and bleached crude oil to remove or reduce the amount of any remaining waxy compounds, and (4) deodorizing the degummed, bleached and optionally winterized natural ester oil to remove or reduce the amount of any remaining volatile impurities to produce the RBD or the RBWD natural ester oil.

3. The method of claim 1 in which the natural ester oil is at least one of sunflower seed oil, canola oil, rapeseed oil, castor oil, soybean oil, palm oil, meadowform seed oil, jojoba oil, algal oils and bio oils from bacterial or fungal species.

4. The method of claim 3 in which the natural ester oil is a sunflower oil.

5. The method of claim 1 in which the absorbent is separated from the oil by filtration.

6. The method of claim 5 comprising separating the absorbent from the oil by filtration with a series of bag filters having a mesh size from 1 micron to 100 microns.

7. The method of claim 1 comprising contacting the natural ester oil with the particles of synthetic magnesium silicate absorbent for a contact time of less than or equal to one hour.

8. The method of claim 1 wherein the natural ester oil comprises contaminants and the particles of synthetic magnesium silicate absorbent removes greater than 50% of the contaminants from the natural ester oil.

9. The method of claim 8 in which the contaminants are selected from the group consisting of water, free fatty acids, aldehydes, ketones, phosphatides, metal soaps, lecithin, trace metals, chlorophylls, color bodies, phospholipids, odiferous compounds, waxes, saturated fats, and combinations thereof.

10. The method of claim 1 comprising controlling, with the circulation pump, the oil flow through the absorbent media cartridge to contact the RBD natural ester oil, or the RBWD natural ester oil, with the particles of synthetic magnesium silicate absorbent at an absorbent/oil ratio from 0.02/1 to 0.15/1.

11. The method of claim 1 comprising controlling, with the circulation pump, the oil flow through the absorbent media cartridge to contact the RBD natural ester oil, or the RBWD natural ester oil, with the particles of synthetic magnesium silicate absorbent at an absorbent/oil ratio from 0.05/1 to 0.2/1.

* * * * *